US006880710B1

(12) United States Patent
Oliveras

(10) Patent No.: US 6,880,710 B1
(45) Date of Patent: Apr. 19, 2005

(54) HOLDER FOR SPECTACLES

(76) Inventor: Maria C. Oliveras, 339 Galicia St. SW., Palm Bay, FL (US) 32908

( * ) Notice: Subject to any disclaimer, the term of this patent is extended or adjusted under 35 U.S.C. 154(b) by 154 days.

(21) Appl. No.: 10/367,151

(22) Filed: Feb. 19, 2003

(51) Int. Cl.[7] ..... A47F 7/02; A45C 11/04
(52) U.S. Cl. ..... 211/85.1; 206/5
(58) Field of Search ..... 206/5, 6, 6.1; 211/85.1, 211/13.1, 85.13, 85.6, 85.4; 434/377, 386, 395, 399

(56) References Cited

U.S. PATENT DOCUMENTS 3,836,007 A * 9/1974 Rosenwein ..... 211/85.1
3,955,681 A * 5/1976 DeZinno ..... 211/85.1
4,180,921 A * 1/1980 Elbaum et al. ..... 434/405
4,204,602 A * 5/1980 Dunchock ..... 211/85.1
4,609,975 A * 9/1986 Badolato et al. ..... 362/125
4,634,004 A * 1/1987 Mortensen ..... 206/387.11
D288,264 S 2/1987 Courtwright et al.
4,898,281 A * 2/1990 Cherry ..... 211/13.1
4,951,811 A 8/1990 Lines
4,993,561 A * 2/1991 Stultz ..... 211/55
5,011,027 A * 4/1991 Van Slett ..... 211/85.1
5,052,550 A 10/1991 Pfenning
5,100,006 A * 3/1992 Forrester ..... 211/85.1
5,101,986 A * 4/1992 Holztrager ..... 211/85.1
5,280,839 A * 1/1994 Crampton ..... 211/85.1
5,390,515 A * 2/1995 Essick ..... 70/63
5,423,505 A * 6/1995 David ..... 248/214
5,509,528 A * 4/1996 Weisburn ..... 206/45.24
5,579,906 A * 12/1996 Fabbri et al. ..... 206/301
5,673,788 A 10/1997 McLane
5,819,957 A * 10/1998 Hahn ..... 211/85.1
5,921,409 A * 7/1999 Gerber et al. ..... 211/85.1
5,944,173 A * 8/1999 Boire et al. ..... 206/1.5
6,041,948 A * 3/2000 Filipak et al. ..... 211/85.1
6,073,782 A * 6/2000 Ascik ..... 211/85.1
6,182,840 B1 * 2/2001 Tegel ..... 211/85.1
6,443,317 B1 * 9/2002 Brozak, Jr. ..... 211/85.1

* cited by examiner

*Primary Examiner*—Kurt Fernstrom

(57) ABSTRACT

A holder for spectacles for storing and protecting a plurality of spectacles includes a flexible panel having a first side, a second side, a top edge, a bottom edge, and a pair of side edges. A plurality of housings is attached to the first side of the panel. Each of the housings has a bottom wall, a top wall, a back wall and a pair of side walls. An upper side of the housing defines an opening in the housings. The openings each have a size and shape adapted for receiving a pair of spectacles.

6 Claims, 2 Drawing Sheets

HOLDER FOR SPECTACLES

BACKGROUND OF THE INVENTION

1. Field of the Invention

The present invention relates to sunglass holders and more particularly pertains to a new sunglass holder for safely and securely holding several pairs of prescription glasses or sunglasses when they are not being worn.

2. Description of the Prior Art

The use of sunglass holders is known in the prior art. U.S. Pat. No. 5,052,550 describes a spectacle case that securely retains a pair of spectacles. Another type of sunglass holder is U.S. Pat. No. 4,951,811 describing a combined eyeglass and contact lens accessory case comprising a foldable member having compartments, which may be moved between open and closed positions. U.S. Pat. No. Des. 288,264 describes an ornamental design for a roll type case. U.S. Pat. No. 5,673,788 describes a collapsible holder for protecting sunglasses.

SUMMARY OF THE INVENTION

The object of the present invention is to provide a new sunglass holder that would keep a quantity of sunglasses or prescription glasses organized in a readily accessible location, which would allow them to be easily retrieved.

Another object of the present invention is to provide a new sunglass holder that prevent the glasses from being lost, misplaced, sat upon, or otherwise damaged (scratched lenses or bent arms) or smudged. Therefore, it could save the consumer the money that may have been spent replacing or repairing glasses that had been damaged or lost.

To this end, the present invention generally comprises a flexible panel having a first side, a second side, a top edge, a bottom edge, and a pair of side edges. A plurality of housings is attached to the first side of the panel. Each of the housings has a bottom wall, a top wall, a back wall and a pair of side walls. An upper side of the housing defines an opening in the housings. The openings each have a size and shape adapted for receiving a pair of spectacles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
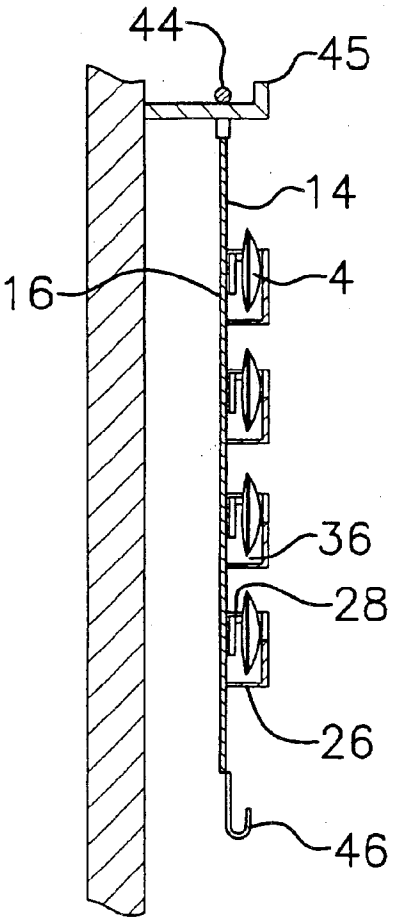
FIG. 2 is a cross-sectional view taken along the line 2—2 of FIG. 1 of the present invention.
Figure 1:
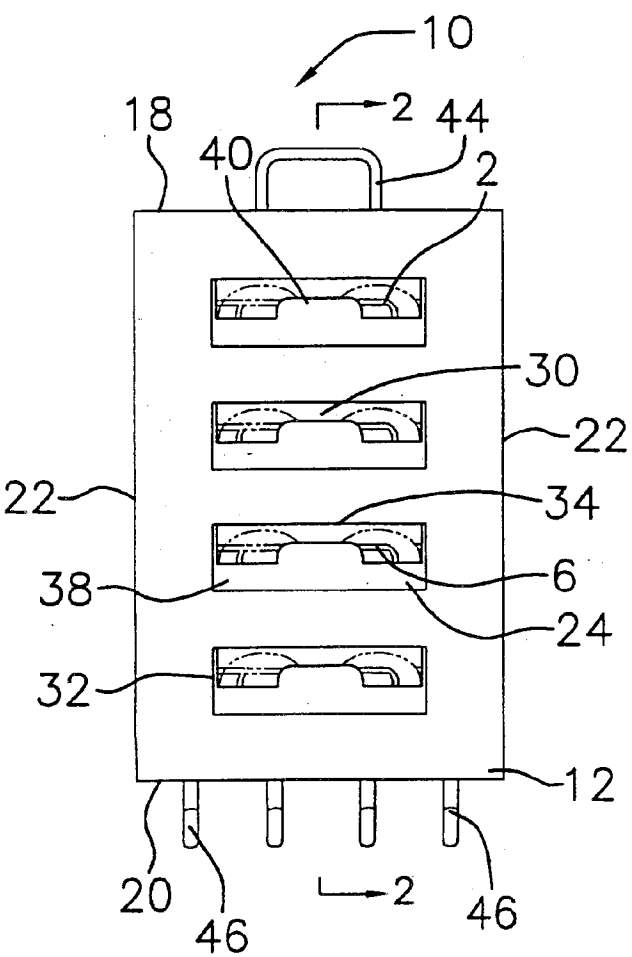
FIG. 1 is a front view of a holder for spectacles according to the present invention.
Figure 3:
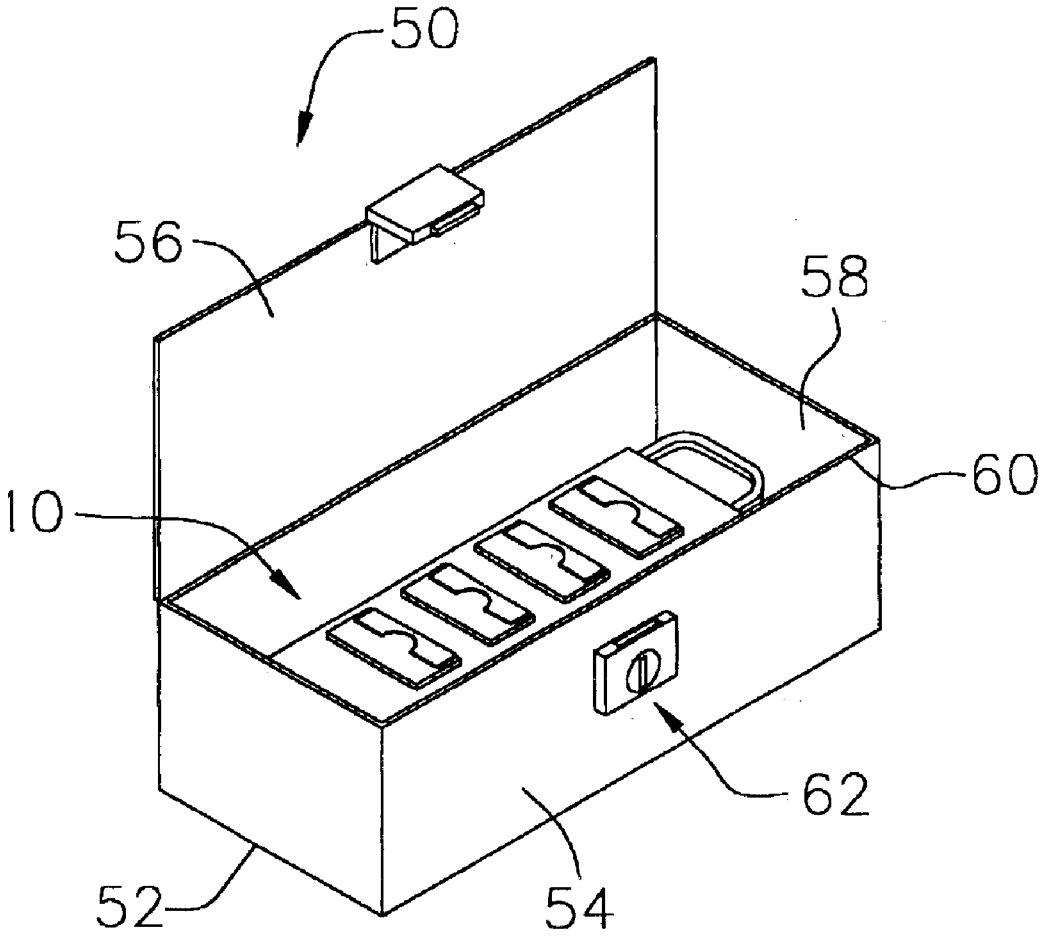
FIG. 3 is a top view of the present invention.

With reference now to the drawings, and in particular to FIGS. 1 through 3 thereof, a new sunglass holder embodying the principles and concepts of the present invention and generally designated by the reference numeral 10 will be described.

As best illustrated in FIGS. 1 through 3, the holder for spectacles 10 includes a panel 12 having a first side 14, a second side 16, a top edge 18, a bottom edge 20, and a pair of side edges 22. The panel 12 comprises a flexible material that is preferably a substantially rigid material such as a plastic material.

A plurality of housings 24 is attached to the first side 14 of the panel 12. Each of the housings 24 has a bottom wall 26, a top wall 28, a back wall 30 and a pair of side walls 32. An upper side 34 of the housing 24 defines an opening 36 in the housings 24. The openings 36 have a size and shape adapted for receiving a pair of spectacles 2. Each of the front walls 38 has a height less than the back wall 30. The front wall 38 has a central portion 40 extending upwardly. Lenses 4 of the spectacles 2 are viewable on either side of the central portion 40 when the spectacles 2 are positioned in the housing 24. The plurality of housings 24 preferably comprises four housings 24.

A handle member 44 is attached to the top edge 18. The handle member 44 may be positioned on a catch 45 for hanging the panel 12 and preferably forms a loop with the top edge 18 of the panel 12. A plurality of hooks 46 is preferably attached to the panel and positioned generally adjacent to the bottom edge 20 of the panel 12. The hooks extend downward from the panel 12 when the panel is hung in a vertical orientation so that items such as keys may be hung from the hooks 46.

A container 50 includes a base wall 52 and peripheral wall 54 that is attached to and extends upwardly from the base wall 52. A lid 56 is pivotally coupled to the peripheral wall 54 for selectively opening or closing an opening 58 defined by an upper edge 60 of the peripheral wall 54. A locking assembly 62 is attached to the container 50 for selectively locking the lid 56 in a closed position.

In use, spectacles 2 may be positioned in the housings 24. The design of the front wall 38 allows viewing of the lenses 4 so that the user may easily chose the desired spectacles 2. The securing member 42 secures the top edge 18 to the bottom edge 20 such that the panel 12 is in a rolled orientation as shown in FIG. 4. This retains the housings 24 within the rolled panel 12 to prevent them from falling from the housing 24. The housings 24 are preferably constructed of a material which will not scratch the lenses 4. It is also preferred that internal surfaces of the housings 24 are coated with a non-abrasive or cushioning material. The panel 12 is removably positionable in the container for storing the panel 12 and spectacles 2 therein.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A holding device for holding a plurality of spectacles, said device comprising:

a panel having a first side, a second side, a top edge, a bottom edge, and a pair of side edges; and a plurality of housings being attached to said first side of said panel, each of said housings having a bottom wall, a top wall, a back wall, a front wall and a pair of side walls, an upper side of said housing defining an opening in said housings, said openings having a size and shape adapted for receiving a pair of spectacles, said front wall of each of said housings has a height less than said back wall, each of said front walls having a central portion extending upwardly, wherein lenses of the spectacles are viewable on either side of the central portion.

2. The holding device as in claim 1, further including a plurality of hooks being attached to said panel, said hooks being positioned adjacent to said bottom edge of said panel.

3. The holding device as in claim 1, further including a handle member being attached to said top edge.

4. The holding device as in claim 3, further including a plurality of hooks being attached to said panel said hooks being positioned adjacent to said bottom edge of said panel.

5. The holding device as in claim 1, further including a container having a base wall and pheripheral wall being attached to a and extending upwardly from said base wall, a lid being pivotally coupled to said peripheral wall for selectively opening or closing an opening defined by an upper edge of said peripheral wall, a locking assembly being attached to said container for selectively locking said lid in a closed position, said container having a size for collectively receiving said panel.

6. A holding device for holding a plurality of spectacles, said device comprising:

a panel having a first side, an second side, a top edge, a bottom edge, and a pair of side edges, said panel comprising a substantially rigid material;

a plurality of housings being attached to said first side of said panel each of said housings having a bottom wall, a top wall, a back wall, a front wall and a pair of side walls, an upper side of said housing defining an opening in said housing said opening having a size and shape adapted for receiving a pair of spectacles each of said front walls having a height less than said back wall, said front wall having a central portion extending upwardly, wherein lenses of the spectacles are viewable on either side of the central portion, said plurality of housings comprising four housing;

a handle member being attached to said top edge;

a plurality of hooks being attached to said panel, said hooks being positioned adjacent to said bottom edge of said panel;

a container having a base wall and peripheral wall being attached to and extending upwardly from said base wall, a lid being pivotally coupled to said peripheral wall for selectively opening or closing an opening defined by an upper edge of said peripheral wall, a locking assembly being attached to said container for selectively locking said lid in a closed position; and wherein said spectacles may be positioned in said housings.

* * * * *